US005159890A

United States Patent [19]

Arnold et al.

[11] Patent Number: 5,159,890

[45] Date of Patent: Nov. 3, 1992

[54] DEVICE FOR STOPPING THE DRIVE OF A SEWING MACHINE IN THE CASE OF A THREAD DISTURBANCE

[75] Inventors: Kurt Arnold, Kaiserslautern; Peter Liell, Stelzenberg, both of Fed. Rep. of Germany

[73] Assignee: G. M. Pfaff Atkiengesellschaft, Kaiserslautern, Fed. Rep. of Germany

[21] Appl. No.: 738,186

[22] Filed: Jul. 30, 1991

[30] Foreign Application Priority Data

Aug. 4, 1990 [DE] Fed. Rep. of Germany ..... 4024846

[51] Int. Cl.[5] ..... D05B 69/36

[52] U.S. Cl. ..... 112/278; 242/37 R

[58] Field of Search ..... 112/278, 273; 242/37 R; 250/561, 571, 560

[56] References Cited

U.S. PATENT DOCUMENTS

| | | | |
|---|---|---|---|
| 3,599,586 | 8/1971 | Newman | 112/278 |
| 4,212,257 | 7/1980 | Herron et al. | 112/278 |
| 4,426,948 | 1/1984 | Olasz et al. | 112/278 X |
| 4,432,297 | 2/1984 | Kemmel | 112/278 |
| 4,602,582 | 7/1986 | Rawson | 112/278 |
| 5,006,719 | 4/1991 | Blaser | 250/560 |

*Primary Examiner*—Peter Nerbun

*Attorney, Agent, or Firm*—McGlew & Tuttle

[57] ABSTRACT

A sewing machine is provided with a device for stopping the drive in the case of a thread disturbance. The device has a light source, a first light guide device for transmitting the light beams to the monitoring point, a second light guide device, via which a signal can be sent to a receiver in the absence of thread at the monitoring point, and a control unit for signal evaluation and to report a thread disturbance, even in the case of maximum deflection of the thread at right angles to the pull-off direction, only when a thread disturbance does really exist. To achieve this, the first light guide device is designed, on its side facing the thread, in a plane perpendicular to the thread pull-off direction, with a radiation outlet which extends preferably in the horizontal direction. The first light guide device causes light beams to be sent over the maximum range of movement of the thread at equal radiation intensity over an entire radiation cross section. A radiation inlet of the second light guide device, whose radiation inlet is intended to receive the light beams passing through the maximum range of movement of the thread at right angles to the pull-off direction after the thread has been removed. The control unit of the device causes a signal to be issued in the case of a change in the intensity of the radiation signal entering the receiver due to the absence of thread in the zone of the monitoring point.

10 Claims, 3 Drawing Sheets

Fig. 5
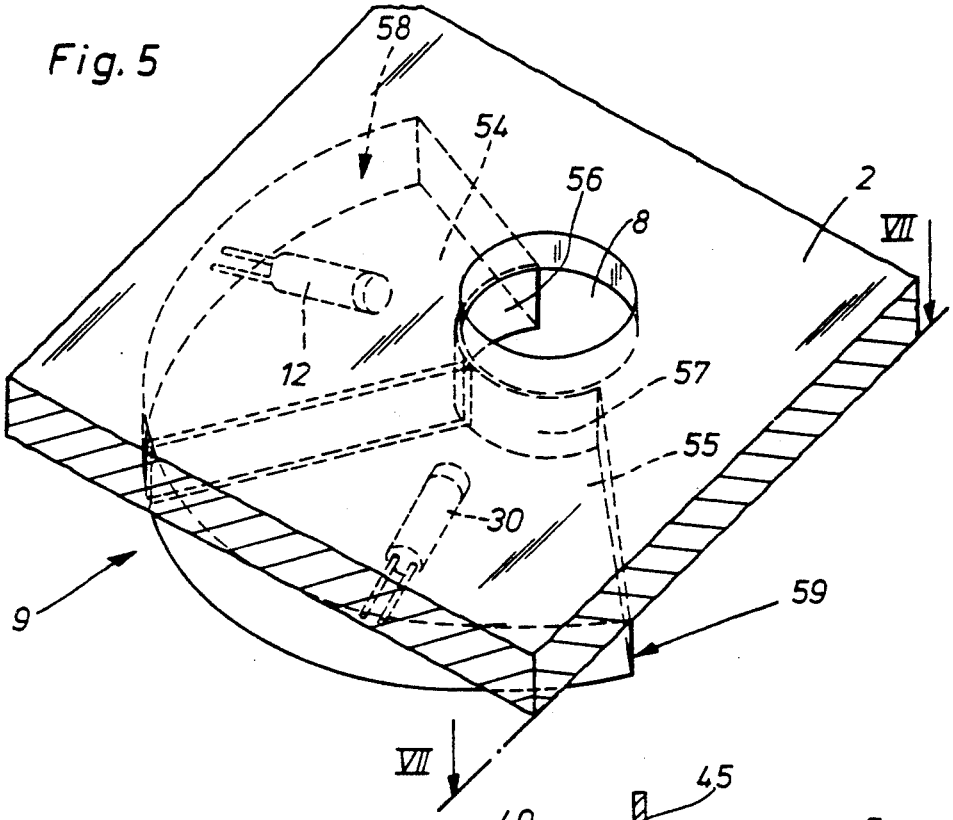
Fig. 3
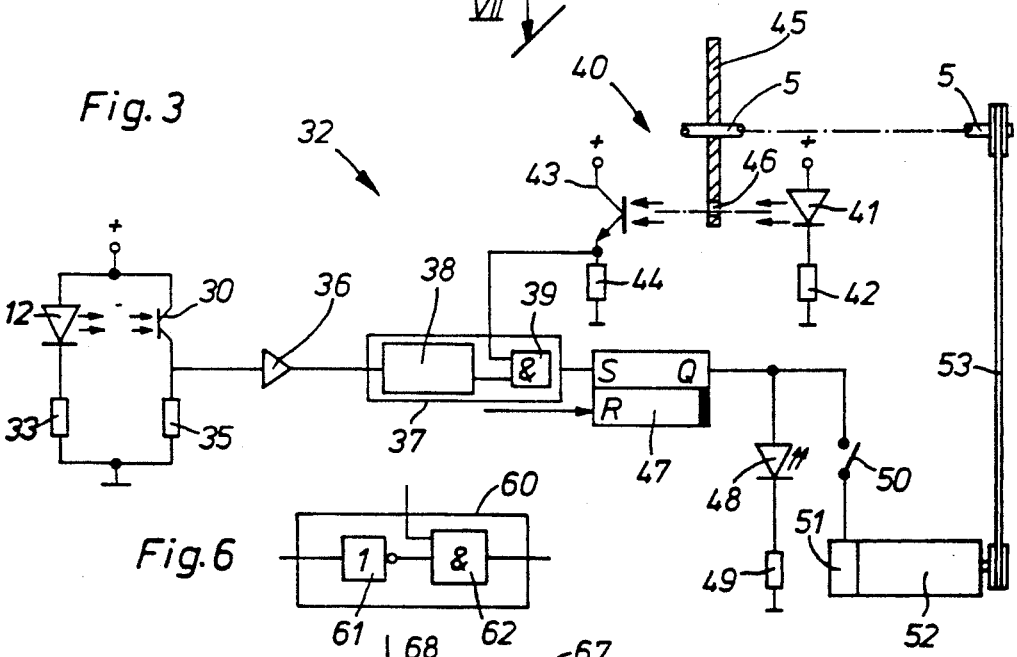
Fig. 6
Fig. 8
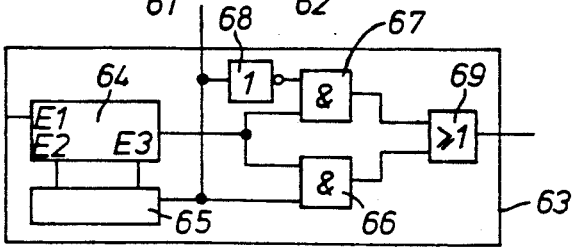

DEVICE FOR STOPPING THE DRIVE OF A SEWING MACHINE IN THE CASE OF A THREAD DISTURBANCE

FIELD OF THE INVENTION

The present invention pertains to a device for stopping a sewing machine drive in the case of a thread disturbance and more particularly relates to a thread monitoring arrangement including a light source and a light receiver.

BACKGROUND OF THE INVENTION

An optoelectronic thread monitor, in which the light beams of a light source are sent via a light guide device to the thread and, after reflection from the thread, via a second light guide device, to a receiver, is known from German patent DE 26,23,856 A1. As soon as the thread is missing at the monitoring point, light beams cease to enter the second light guide device and consequently the receiver as well. After which a signal evaluating device following this will send a signal.

The reliability of operation of this thread monitor is guaranteed as long as the thread does not perform any movement at right angles to the pull-off direction, or the thread is deflected only slightly.

In stitch-forming machines, the needle thread is deflected alternatingly in mutually opposite directions at right angles to the pull-off direction as a consequence of the up and down movements of the needle bar from its middle position. Due to the rotary and oscillating movements of the hook, a movement directed at right angles to the pull-off direction is also transmitted to the hook thread. Irregularities in stitch formation may even bring about a deflection of the needle thread and/or hook thread by an amount equaling several times the "normal" transverse deflection caused by the working movement of the stitch-forming elements. It can therefore be assumed in connection with the use of the above-described thread monitor on stitch-forming machines that the thread will leave the range of action of the thread monitor, at the latest, at the time of onset of an irregularity in stitch formation—if it does not swing out of the range of action of the thread monitors even during the sewing process in cadence with the stitch formation—as a result of which the indication of a thread disturbance, that does not exist in reality, would be brought about. Such a thread monitor is therefore unsuitable for use on such machines.

SUMMARY AND OBJECTS OF THE INVENTION

It is an object of the present invention to design a device of this class, which will hereinafter be called a thread monitor, such that a thread disturbance is reported only when it really exists even in the case of maximum deflection of the thread at right angles to the pull-off direction.

According to the invention, a sewing machine thread monitoring arrangement is provided comprising a light source and a first light guide means having a light radiation outlet on a side facing the thread being monitored. The radiation outlet preferably extends in a horizontal direction and in a plane at right angles to the direction of thread pull off and provides light beams distributed over a maximum range of movement of the thread with a substantially equal radiation intensity over a radiation cross section. A second light guide means is provided for receiving a radiation signal for determining the absence of thread at a monitoring point. The second radiation means includes a radiation inlet extending in a plane for receiving light beams passing through the maximum range of movement of the thread from the radiation outlet. Control means are provided for evaluating signals from the second light guide device and for generating a signal in the case of a change in intensity of the radiation signal entering a receiver connected to said radiation inlet. The change in intensity of the radiation signal corresponds to the absence of thread in the zone of the monitoring point.

Based on the expansion of the radiation outlet of the first light guide device, preferably in a direction extending at right angles to the pull-off direction of the thread, it is possible to generate a light field that extends up to the limits of the range of movement of the thread at right angles to the pull-off direction, so that the thread will not leave the light field even in the case of maximum transverse deflection. In cooperation with the radiation inlet of the second light guide device, which inlet is designed such that it is able to receive all the light beams passing through the maximum range of movement of the thread at right angles to the pull-off direction after exit from the first light guide device, the thread is always located in the range of action of the thread monitor and can therefore be monitored without interruption.

As long as no thread disturbance is present, the second light guide device receives a radiation signal of a predetermined intensity. In a first embodiment, in which the two light guide devices are located opposite one another, this intensity is obtained from the overall radiation passing through the maximum rage of action of the thread at right angles to the pull-off direction, minus the radiation component reflected by the thread. In the second embodiment, with light guide devices arranged next to one another, this intensity is determined exclusively by the radiation component reflected by the thread toward the radiation inlet of the second light guide device.

The intensity of the radiation signal entering the second light guide device depends on the amplitude of deflection of the thread because of the uniform radiation density produced by the radiation inlet of the first light guide device at right angles to the direction of propagation of the light beams. In the first embodiment, a change in the thread position at the monitoring point brings about a displacement of the range in which no light beams arrive because of the thread always interrupting the path of an equal number of rays. In the second embodiment, the range in which the light beams reflected by the thread enter the second light guide device will be displaced but equal.

In the first embodiment, the lack of thread at the monitoring point leads to an increase in the radiation signal entering the second light guide device by the radiation component previously reflected by the thread. In the second embodiment, in which the radiation signal is formed exclusively by the reflected radiation component, the reception of the radiation signal ends with the loss of thread.

When a thread disturbance is recognized by the control unit, the latter causes, by sending a signal, a display device indicating the thread disturbance to be switched on and/or the working movement of the stitch-forming elements to be stopped.

The use of light guide fibers for both light guide devices according to claim 2 offers the advantage that the light guide devices can be optimally adapted, in terms of their shape, to the space conditions prevailing at the monitoring point. By arranging all fiber ends in a horizontal direction to form the radiation inlet and outlet, the overall height of the light guide devices is very small, so that they can preferably be used at monitoring points at which little space is available in the pull-off direction of the thread for accommodating a thread monitor.

Due to parallel arrangement of the fiber ends, equality of the direction of the light beams is achieved, which brings about uniform radiation density of the light field in conjunction with the equidistant arrangement of the fiber ends. In addition, the equality of the direction of the light beams makes it possible to design the reception range of the radiation inlet of the second light guide device in the direction perpendicular to the thread with a width that corresponds to that of the radiation cross section of the radiation outlet of the first light guide device.

Utilizing a flat design, the light guide devices use light guide fibers wherein the ends of the light guide fibers form the radiation outlet of the first light guide device. The second light guide device has a radiation inlet formed by ends of other light guide fibers. The light guide fibers of both light guide devices are arranged in parallel and at equal distances from one another. According to this design, thread monitoring in the stitch hole is possible even in the case of machines with extremely limited space conditions in the zone of the needle plate in the thread pull-off direction. However, if the stitch hole is selected to be the monitoring point, it should be borne in mind that the needle thread can be monitored only during the phase of stitch formation, in which it passes through the stitch hole. For uninterrupted monitoring of the hook thread at this monitoring point, it must be taken into account in connection with the evaluation of the intensity of the radiation signal entering the receiver that when the needle has entered the stitch hole, the needle will interrupt the path of the light beams together with the needle thread and the hook thread, whereas only the hook thread is located in the path of the light beams when the needle is located outside the stitch hole.

The advantages described in connection with the light guide fibers can also be achieved by designing the light guide devices with a light guide strip instead of light guide fibers.

Another preferred embodiment of the present invention is to form the two light guide devices from transparent plates. A plate associated with the first light guide device is designed to form a radiation outlet on one side. The side forming the radiation outlet is designed to be light scattering. A transparent plate associated with the second light guide device has a side forming the radiation inlet. The side forming the radiation inlet is designed to be light collecting. This embodiment is directed toward the design of the light guide elements, with which the thread monitoring according to the present invention can be carried out with a very simple design.

Accommodating the light source and the receiver in one of the respective transparent plates according to the second preferred embodiment leads to the advantage that it will be possible to avoid the loss of light beams, which otherwise occurs with the transition from the light source to the plate or from the plate to the receiver as a consequence of the change of the medium, as well as losses which would occur due to the deposition of dust and lint between the light source and the plate of the first light guide device, on one hand, and between the plate of the second light guide device and the receiver, on the other hand.

The monitoring point of a stitch-forming machine at which the thread monitor according to the first or second embodiment can be used particularly advantageously by mounting the thread monitor to the underside of the needle plate in the area of the stitch hole.

A further object of the invention is to provide a sewing machine light monitoring device which is superior in design, rugged in construction and economical to manufacture.

The present invention will be explained on the basis of two embodiments represented in the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is the control unit according to the invention that makes it possible to monitor the hook thread;

FIG. 5 is a second embodiment of the thread monitor according to the invention;

FIG. 6 is a circuit component for adapting the control unit according to FIG. 3 to the second embodiment according to the invention;

FIG. 8 is a circuit component needed for the control unit according to FIG. 3 for monitoring the needle thread and hook thread.

DETAILED DESCRIPTION OF THE PREFERRED EMBODIMENTS

Figure 1:
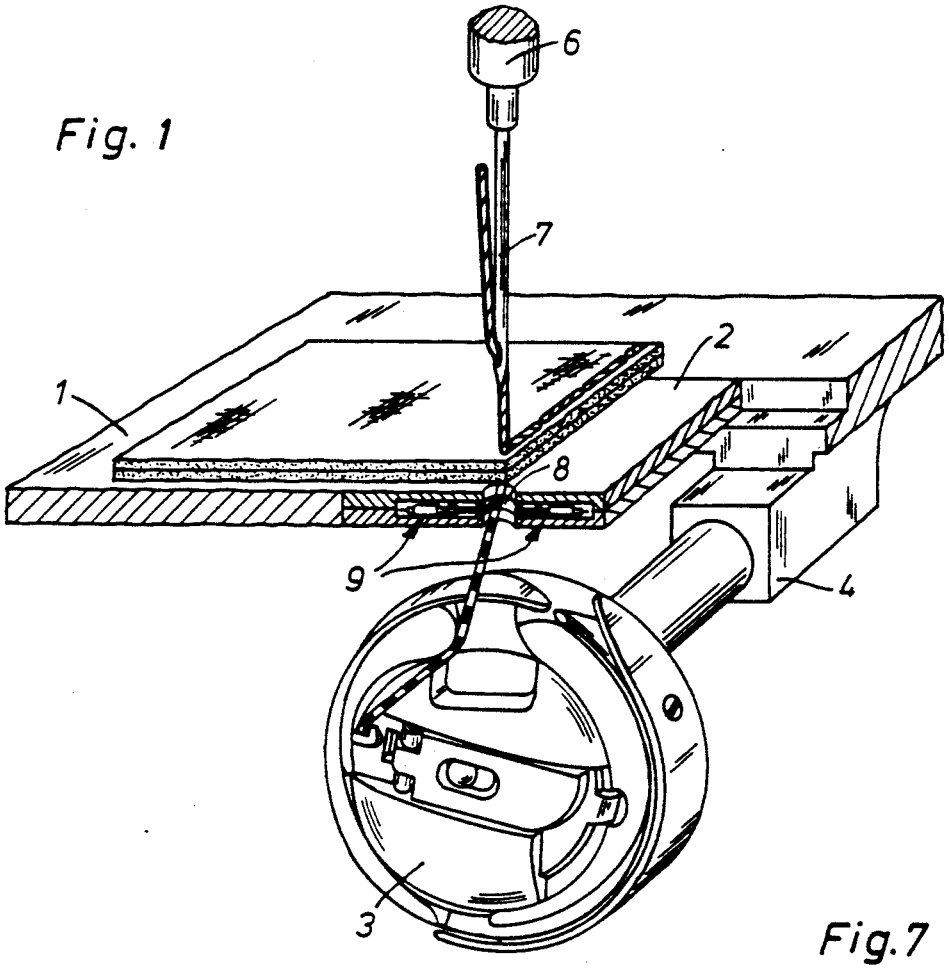
FIG. 1 is a thread monitor arranged in the zone of the stitch hole of a sewing machine.

FIG. 1 shows the fabric support plate 1 of a sewing machine which receives a stitch plate 2. The stitch plate 2 covers the are above a double lock stitch hook which is mounted in a projection 4 of the fabric support plate 1 and is driven, in a manner not shown, at a speed equaling twice the speed of the main shaft 5 (FIG. 3). A needle bar 6, which caries a thread-carrying needle 7, cooperates with the hook 3. The needle bar 6 is in driving connection with the main shaft 5 in a manner not shown.

Figure 2:
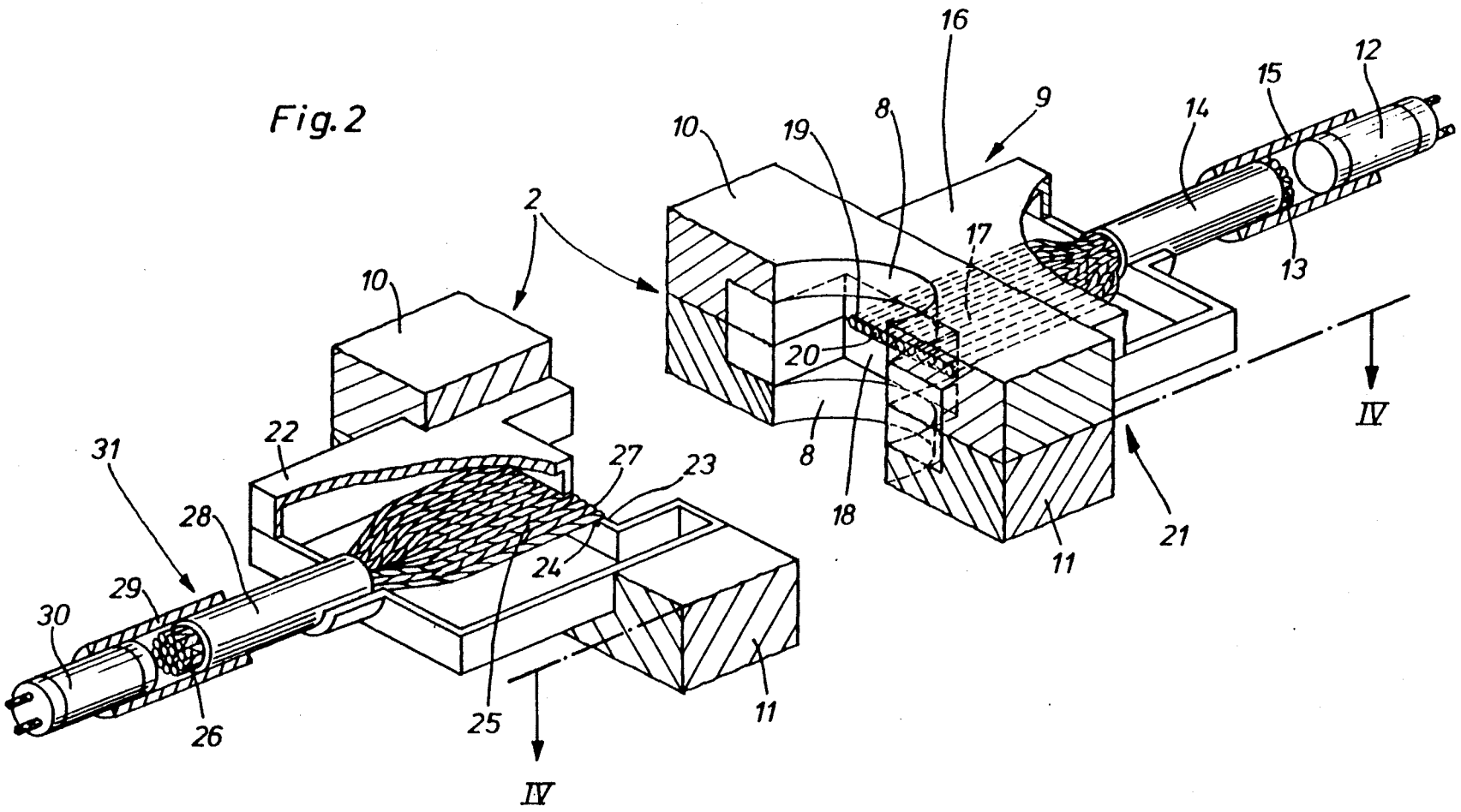
FIG. 2 is an enlarged detail of the thread monitor according to FIG. 1.

The needle plate 2 has a stitch hole 8 which serves as a monitoring point for a thread monitor 9 used to monitor the hook thread. To receive the thread monitor 9 shown in FIG. 2 on a larger scale, the needle plate 2 has a multilayer design, wherein the underside of an upper cover plate 10 and the top side of a lower cover plate 11 have a recess for the thread monitor 9 in the zone of the stitch hole 8.

The thread monitor 9 is provided with a light source 12 which is adjoined by a plurality of light guide fibers 13 (see FIG. 2) which are received in a jacket 14. The end of the jacket 14 facing the light source 12, as well as the light source 12, are received in a sleeve 15 The other end of the jacket 14 is led into a radiator 16, in which light guide fibers 13 are distributed such that their ends 17 are arranged at a location perpendicular to the pull-off direction of the hook thread over a width corresponding to the diameter of the stitch hole 8. The guide fibers 13 are preferably at equal distances from one another, extending parallel to one another, and end flush with the stitch hole-side closure 18 of the radiator 16. The radiator 16 is designed with a slit 19 for the passage of the fiber ends 17. In conjunction with the fiber ends 17, the slit 19 forms the radiation outlet 20 of the radiator 16, and the radiation cross section of the radiation outlet 20 is obtained as the sum of the cross sectional areas of all fiber ends 17.

A light guide device 21 is formed from the elements 12 through 16.

On the opposite side of the stitch hole 8, opposite the radiation outlet 20 of the radiator 16, a radiation receiver 22 is arranged, which has a slit 24 for passage of the fiber ends 25 of light guide fibers 26 at its stitch hole-side closure 23. The slit 24 forms, together with the fiber ends 25, a radiation inlet 27, whose dimensions and direction of extension correspond to those of the radiation outlet 20 of the radiator 16, and the zone of reception of the radiation inlet 27 is obtained as the sum of the cross sectional areas of all fiber ends 25.

In the radiation receiver 22, the light guide fibers 26 are integrated into a bundle and led into a jacket 28, which is guided into the radiation receiver 22. The other end of the jacket is held in a sleeve 29, in which a receiver 30 is accommodated.

The elements 22, 26, and 28 through 30 form a light guide device 31.

FIG. 3 shows a simplified circuit diagram with the components necessary for the function of the electrical control unit 32 of the thread monitor 9. Current flows from the positive pole of a stabilized power source to ground via the light source 12 and a resistor 33. Current also flows from the positive pole of the power source to ground via the receiver 30 designed as a phototransistor and a resistor 35.

The emitter of the receiver 30 is connected to a circuit component 37 via an amplifier 36. This circuit component 37 has a threshold value switch 38 and an AND element 39, and the input of the threshold value switch 38 is connected to the amplifier 36, and the output is connected to an input of the AND element 39. A position transducer 40 indicating the rotation position of the main shaft 5 is connected to the other input of the AND element 39; the position transducer 40 has a photodiode 41, which is connected to the positive pole of a stabilizer power source and is grounded via a resistor 42 and a photodetector 43, which is also connected to the positive pole of a power source, is designed as a phototransistor, and is grounded via a resistor 44. A disk 45 is nonrotatably arranged on the main shaft 5 between the photodiode 41 and the photodetector 43, and at a distance from its axis of rotation, which is determined by the path of light between the photodiode 41 and the photodetector 43, the disk 45 has an opening 46 which extends over a predetermined angle along this radius.

The output of the AND element 39 is connected to the setting input S of a flipflop memory 47. The output Q of the memory 47 is connected to a display element 48 which is grounded via a resistor 49. In addition, a switch 50 which is connected to a shut-off device 51 of a drive motor 52, is connected to the output Q. The drive motor 52 drives the main shaft 5 via a V-belt 53.

The thread monitor 9 operates as follows:

By correspondingly arranging and dimensioning the opening 46 in the disk 45, the position transducer 40 is designed such that as soon as the needle 7 has left the stitch hole 8 on its way into its upper reversal position, the thread monitor 9 is enabled to function by the position transducer 40 sending a signal to the AND element 39. As soon as the needle 7 begins to enter the stitch hole 8 on its way into its lower reversal position, the thread monitor 9 is rendered unable to function by the position transducer 40 ceasing to send a signal to the AND element 39. It is thus achieved that the thread monitor 9 acts only during the time period during which the stitch hole 8 is passed through exclusively by the hook thread.

Figure 4:
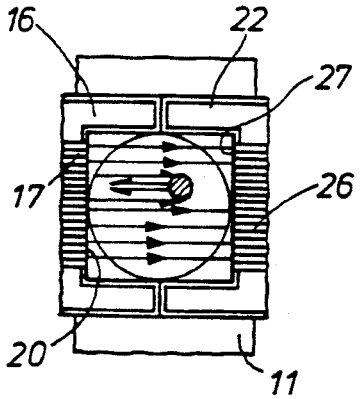
FIG. 4 is a representation of the radiation produced by the thread monitor in the stitch hole according to the invention.

The light beams emitted by the light source 12 are distributed among the light guide fibers 13 and are guided by these to the stitch hole 8. A light field extends, as shown in FIG. 4, in an area perpendicular to the direction of pull-off of the hook thread. The extent of the light field at right angles to the direction of propagation of the light beam corresponds to the diameter of the stitch hole 8 and consequently to the maximum deflection of the hook thread in the stitch hole 8. This light field is formed by the light beams exiting from the fiber ends 17. Since the dimensions and the direction of extension of the radiation inlet 27 of the second light guide device 31 correspond to those of the radiation outlet 20 of the first light guide device 21, all the light beams emitted from the radiation outlet 20 are able to reach the receiver 30 via the radiation inlet 27, with the exception of the light beams which reach the hook thread and are reflected by same.

The light beams make the receiver 30 conducting, and current will flow to ground via the resistor 35. The voltage across resistor 35 is sent to the threshold value switch 38 via the amplifier 36. The switching threshold of the threshold value switch 38 is set such that as long as the hook thread is reflecting part of the light beams, the intensity of the radiation signal received is not sufficient to exceed this switching threshold.

As soon as no hook thread is passing through the stitch hole 8, as a consequence of a thread disturbance, all the light beams sent to the radiation outlet 20 will enter the radiation inlet 27 and increase the intensity of the radiation signal being sent to the receiver 30 by the radiation component previously reflected by the hook thread. As a result, the switching threshold of the threshold value switch 38 will be exceeded. The switch 38 will send a signal to the AND element 39. Since the position transducer 40 sends a signal to the second input of the AND element 39 during the entire time period during which the needle 7 is located above the stitch hole 8, the signal of the threshold value switch 38 will connect through the AND element 39 when the needle 7 is above the stitch hole 8. As a result the setting input S of the memory 47 receives a signal. Via its output Q, the memory 47 turns on the display element 48, which indicates the thread disturbance to the operator. With switch 50 closed, the output Q of the memory 47 also operates at the same time the shut-off device 51, which switches off the drive motor 52 immediately or prevents the drive motor 52 from restarting after the next stopping process, depending on the design.

With the elimination of the thread disturbance, an electrical signal is sent in a suitable manner to the resetting input R of the memory 47, so that this memory 47 will switch off the display element 48 and release the drive motor 52.

In a second embodiment of the thread monitor 9 shown in FIG. 5, two transparent plates 54 and 55, which may consist of, e.g., epoxy resin, are fastened next to one another on the undersize of the needle plate 2 in the area of the stitch hole 8. The first plate 54 serves to receive the light source 12, facing the stitch hole 8. First plate 54 is provided with a light-scattering radiation outlet 56, while the second plate 55 is intended to receive the receiver 30, and is provided, on the side facing the stitch hole 8, with a radiation inlet 57 that bundles the light beams and is directed toward the receiver 30.

A first light guide device 58 is formed from the elements 12 and 54, and a second light guide device 59 is formed from the elements 30 and 55.

The control unit 32 used for the first embodiment of the thread monitor 9 can also be used in the second embodiment if the circuit component 37 is replaced with a circuit component 60 shown in FIG. 6, which has a NOT element 61 and an AND element 62.

Figure 7:
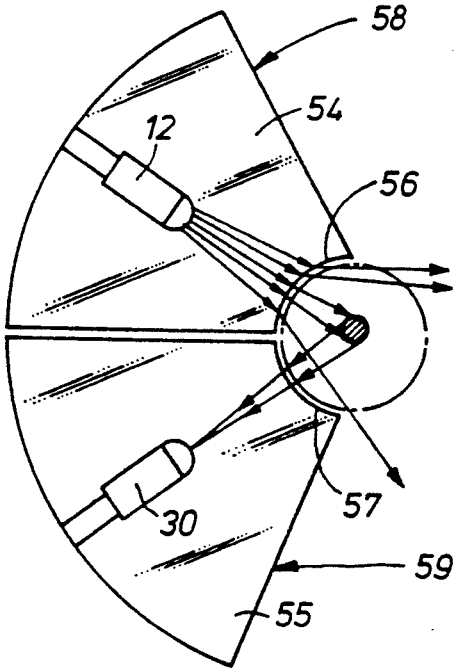
FIG. 7 is a representation of the radiation generated by the second embodiment in the stitch hole according to the invention.

The second embodiment of the thread monitor 9 operates as follows:

As is shown in FIG. 7, the light beams emitted by the light source 12 are distributed by the radiation outlet 56 of the light guide device 58 into the stitch hole 8. Since the hook thread is the only obstacle to the light beams when hook threads are present in the stitch hole 8, part of the light beams reaching the hook thread is reflected to the second light guide device 59 and refracted on entry into its radiation inlet 57 toward the receiver 30. The radiation signal is sent from the receiver 30 via the amplifier 36 to the NOT element 61, whose output will not subsequently carry any signal.

When, in contrast, the hook thread is missing in the stitch hole 8 as a consequence of a thread disturbance, no more light beams are sent to the receiver 30. A signal will thus be present at the output of the NOT element 61 and consequently at the input of the AND element 62 associated with it. Since a continuous signal produced by the position transducer 40 is present at the other input of the AND element 62 during the phase of monitoring of the hook thread, the AND element 62 will be conducting, and its output will send a signal to the setting input S of the memory 47, by which the above-described switching processes are induced.

If the thread monitor 9 is intended to monitor the needle thread and the hook thread in the area of the stitch hole 8, the circuit component 37 of the control unit 32 is replaced with the circuit component 63 shown in FIG. 8 if the first embodiment of the thread monitor 9 is used. This circuit component 63 has a threshold value switch 64 provided with a plurality of inputs E1 through E3. Input E1 is connected to the amplifier 36. A final control element 65 connected to the position transducer 40 are connected to inputs E2 and E3. The output of the threshold value switch 64 is connected to one input each of the AND elements 66 and 67. The position transducer 40 is directly connected to the second input of the AND element 66, while it is connected to the second input of the AND element 67 via a NOT element 68. Both outputs of the AND elements 66, 67 are connected to an OR element 69, whose output is connected to the setting input S of the memory 47.

While only the hook thread extends in the stitch hole when the needle 7 is located above the stitch hole 8, when the needle 7 enters the stitch hole 8, the needle thread is also in the range of monitoring of the thread monitor 9, in addition to the hook thread, and next to it the needle. As a result of which a larger percentage of the light beams passing through the stitch hole 8 will be reflected, and this percentage will not therefore reach the radiation inlet 27 of the second light guide device 31. The lower intensity of the radiation signal is taken into account such that at the beginning of the latter stitch formation phase, during which no signal is sent to the final control element 65 from the position transducer 40, the output of the final control element 65, which output is connected to the input E2 of the threshold value switch 64, sends a signal that brings about a reduction of the threshold value by the amount of the radiation component that can be reflected from the needle 7 and the needle thread.

An increase in the intensity of the radiation signal entering the receiver 30 by an amount of the radiation component previously reflected from the needle thread and/or the hook thread causes a signal from the threshold value switch 64 to be sent to the input of the AND elements 66 and 67 associated with it. No signal is present at the second input of the AND element 66 during this stitch formation phase. The AND element 67, whose second input carries a signal because of the NOT element 68, is conducting. A signal is now sent to the setting input S of the memory 47 via the OR element 69.

As soon as a signal of the position transducer 40 indicates to the final control element 65 that the needle 7 has left the stitch hole 8, the final control element 65 sends a signal to the input E3 of the threshold value switch 64, as a result of which its switching threshold is again raised to the original value. When this switching threshold is exceeded, the threshold value switch 64 sends a signal to the two AND elements 66 and 67. Since a signal of the position transducer 40 is present at the second input of the AND element 66 during this stitch formation phase, this AND element 66 will be connected through, and send a signal to the setting input S of the memory 47 via the OR element 69.

While specific embodiments of the invention have been shown and described in detail to illustrate the application of the principles of the invention, it will be understood that the invention may be embodied otherwise without departing from such principles.

What is claimed is:

1. A sewing machine thread monitoring device, comprising: a light source; first light guide means for transmitting light beams to a monitoring point including a radiation outlet in a plane perpendicular to a direction of thread pull off for providing light beam over a maximum range of movement of a sewing machine thread with substantially equal radiation intensity over a radiation cross section; second light guide means connected to a receiver and including a radiation inlet for receiving light beams passing through said maximum range of movement of the thread perpendicular to the pull-off direction after being emitted from said radiation outlet; and, control means connected to said receiver for generating a signal in response to a change in intensity of a radiation signal entering said radiation inlet, said change in intensity representing an absence of thread in a zone of said monitoring point, said first and second light guide means each include a plurality of light guide fibers, each of said light guide fibers having ends, said ends of said first light guide means forming said radiation outlet and said ends of said second light means forming said radiation inlet, said ends of said light guide fibers being arranged substantially in parallel and spaced substantially in equal distance from one another, said ends of said light guide fibers being imbedded between two cover plates of a multi-layer needle plate, said ends terminating in a zone at an edge of a stitch hole formed in said needle plate.

2. A sewing machine thread monitoring device, comprising: a light source; first light guide means for transmitting light beam including a radiation outlet facing a thread and for directing said light beams from the light source to the thread, said radiation outlet extending in a direction perpendicular to a pull-off direction occupied by the thread without transverse deflection up to a limit of a maximum range of movement of the thread in a transverse direction, said radiation outlet including an emission area of generation of a uniform radiation density over an emission cross section; second light guide means connected to a receiver and including a radiation inlet for receiving light beams after passage of said light beams through a monitoring zone, said radiation inlet extending in a direction corresponding to the direction of extension of said radiation outlet of said first light guide means at least up to a limit of a maximum range of movement of said thread; and, control means connected to said receiver for generating a signal in response to a change in a radiation signal sent to said receiver by said second light guide means, said change in radiation signal being caused by lack of thread in said monitoring zone.

3. A sewing machine according to claim 2, wherein said first and second light guide means each includes a plurality of optical fibers that extend, at least at one end substantially in parallel and substantially spaced at equal distances from one another.

4. A sewing machine according to claim 2, wherein said ends of said light guide fibers are embedded between two cover plates of a multi-layer needle plate, said ends terminating in a zone at an edge of a stitch hole formed in said needle plate.

5. A sewing machine according to claim 2, wherein said first and second light guide means each includes a transparent plate, said first light guide means plate including a light-scattering side forming said radiation outlet, and said second light guide means and plate including a light-collecting side forming said radiation inlet.

6. A sewing machine according to claim 3, wherein said first light guide means receives said light source and said second light guide means receives said receiver.

7. A sewing machine according to claim 5, wherein each of said plates are fastened to an underside of said needle plate in an area of said stitch hole.

8. A sewing machine according to claim 6, wherein each of said plates are fastened to an underside of said needle plate in an area of said stitch hole.

9. A sewing machine thread monitoring device, comprising: a light source; first light guide means for transmitting light beams to a monitoring point including a radiation outlet extending in a plane perpendicular to a direction of thread pull off for providing light beams over a monitoring area extending over a maximum range of transverse movement of the a sewing machine thread with substantially equal radiation intensity over a radiation cross section; second light guide means connected to a receiver and including a radiation inlet for receiving light beams passing through said maximum range of transverse movement of the thread, said inlet extending in a plane perpendicular to the pull-off direction, said inlet being positioned for receiving said light beams passing through said monitoring area; and, control means connected to said receiver for generating a signal, to initiate a switching and/or a display process, in response to a change in intensity of said a radiation signal entering said radiation inlet, said change in intensity representing an absence of thread in said monitoring area.

10. A sewing machine thread monitoring device according to claim 9 wherein said first and second light guide means each include a plurality of light guide fibers, each of said light guide fibers having ends, said ends of said first light guide means forming said radiation outlet and said ends of said second light guide means forming said radiation inlet, said ends of said light guide fibers being arranged substantially in parallel and spaced substantially in equal distance from one another, said ends of said light guide fibers being imbedded between two cover plates of a multi-layer needle plate, said ends terminating in a zone at an edge of a stitch hole formed in said needle plate.

* * * * *